US009145747B2

(12) United States Patent
Kapila et al.

(10) Patent No.: US 9,145,747 B2
(45) Date of Patent: Sep. 29, 2015

(54) METHODS AND APPARATUSES FOR MIXING DRILLING FLUIDS

(75) Inventors: Mukesh Kapila, The Woodlands, TX (US); Paul Newman, Bedford (CA); Katerina Newman, Houston, TX (US); Perry Lomond, Houston, TX (US)

(73) Assignee: M-I L.L.C., Houston, TX (US)

( * ) Notice: Subject to any disclaimer, the term of this patent is extended or adjusted under 35 U.S.C. 154(b) by 1103 days.

(21) Appl. No.: 13/129,429

(22) PCT Filed: Nov. 24, 2009

(86) PCT No.: PCT/US2009/006762
§ 371 (c)(1),
(2), (4) Date: May 16, 2011

(87) PCT Pub. No.: WO2010/060092
PCT Pub. Date: May 27, 2010

(65) Prior Publication Data

US 2011/0232909 A1 Sep. 29, 2011

Related U.S. Application Data

(60) Provisional application No. 61/117,490, filed on Nov. 24, 2008.

(51) Int. Cl.

| | |
|---|---|
| ***B01F 5/04*** | (2006.01) |
| ***E21B 21/06*** | (2006.01) |
| ***B01F 7/00*** | (2006.01) |
| ***B01F 13/10*** | (2006.01) |

(52) U.S. Cl.
CPC ..... *E21B 21/062* (2013.01); *B01F 7/00766* (2013.01); *B01F 13/1013* (2013.01); *B01F 13/1016* (2013.01)

(58) Field of Classification Search
USPC ..... 366/290, 315, 316
See application file for complete search history.

(56) References Cited

U.S. PATENT DOCUMENTS

| | | | | |
|---|---|---|---|---|
| 4,516,860 | A | 5/1985 | van der Laan et al. | |
| 2006/0225924 | A1 | 10/2006 | Ivan et al. | |
| 2007/0135311 | A1 * | 6/2007 | Van Der Horst | 507/110 |
| 2008/0041449 | A1 | 2/2008 | Schauerte | |
| 2009/0001188 | A1 * | 1/2009 | Hassan et al. | 239/10 |

FOREIGN PATENT DOCUMENTS

| | | | |
|---|---|---|---|
| CA | 2216045 | A1 | 2/1999 |
| WO | 80-01469 | A1 | 7/1980 |

OTHER PUBLICATIONS

Office Action issued in corresponding Canadian Application No. 2,744,046; Dated Oct. 16, 2012 (2 pages).
Official Action issued in corresponding Mexican Application No. MX/a/2011/005392 with English language communication reporting the same; Dated Mar. 11, 2014 (4 pages).
Office Action issued in corresponding Canadian Application No. 2,744,046; Dated Aug. 20, 2013 (2 pages).
(Continued)

*Primary Examiner* — James Sanders

(57) ABSTRACT

A method of mixing drilling fluids, the method including injecting a drilling fluid into a high shear mixing unit and processing the drilling fluid with the high shear mixing unit. The processing includes forcing the drilling fluid through a first row of teeth of a first stage.

12 Claims, 5 Drawing Sheets

(56) References Cited

OTHER PUBLICATIONS

Official Action issued in corresponding Mexican Application No. MX/a/2011/005392 with English language communication reporting the same; Dated Sep. 27, 2013 (5 pages).

International Search Report issued in PCT/US2009/065762, mailed on Jul. 12, 2010, 3 pages.

Written Opinion issued in PCT/US2009/065762, mailed on Jul. 12, 2010, 3 pages.

Office Action issued in corresponding Mexican Application No. MX/a/2011/005392 with English correspondence reporting the same; Dated Jul. 16, 2014 (5 pages).

* cited by examiner

METHODS AND APPARATUSES FOR MIXING DRILLING FLUIDS

BACKGROUND

1. Field of the Disclosure

Embodiments disclosed herein relate generally to methods and apparatuses for mixing drilling fluids. More specifically, embodiments disclosed herein relate to methods and apparatuses for mixing drilling fluids with high shear mixers. More specifically still, embodiments disclosed herein relate to methods and apparatuses for mixing drilling fluids with multiple stage high shear mixers.

2. Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

In general, drilling fluids should be pumpable under pressure down through strings of drilling pipe, then through and around the drilling bit head deep in the earth, and then returned back to the earth's surface through an annulus between the outside of the drill stem and the hole wall or casing. Beyond providing drilling lubrication and retarding wear, drilling fluids should suspend and transport solid particles to the surface for screening out and disposal. In addition, these fluids should be capable of suspending additive weighting agents (to increase specific gravity of the mud and transporting clay and other substances capable of adhering to the borehole, back to the surface.

Drilling fluids are generally characterized as thixotropic fluid systems. That is, they exhibit low viscosity when sheared, such as when in circulation (as occurs during pumping or contact with the moving drilling bit). However, when the shearing action is halted, the fluid should be capable of suspending the solids it contains to prevent gravity separation. In addition, when the drilling fluid is under shear conditions and a free-flowing near-liquid, it must retain a sufficiently high enough viscosity to carry all unwanted particulate matter from the bottom of the well bore to the surface. The drilling fluid formulation should also allow the cuttings and other unwanted particulate material to be removed or otherwise settle out from the liquid fraction.

There is an increasing need for drilling fluids having the rheological profiles that enable these wells to be drilled more easily. Drilling fluids having tailored rheological properties ensure that cuttings are removed from the wellbore as efficiently and effectively as possible to avoid the formation of cuttings beds in the well which may cause the drill string to become stuck, among other issues. There is also the need, from a drilling fluid hydraulics perspective (equivalent circulating density), to reduce the pressures required to circulate the fluid. This helps to avoid exposing the formation to excessive forces that may fracture the formation causing the fluid, and possibly the well, to be lost. In addition, an enhanced profile is necessary to prevent settlement or sag of the weighting agent in the fluid. If this occurs, it can lead to an uneven density profile within the circulating fluid system that may result in well control (gas/fluid influx) and wellbore stability problems (caving/fractures).

To obtain the fluid characteristics required to meet these challenges, the fluid must be easy to pump, so it requires the minimum amount of pressure to force it through restrictions in the circulating fluid system, such as bit nozzles or downhole tools. In other words, the fluid must have the lowest possible viscosity under high shear conditions. Conversely, in zones of the well where the area for fluid flow is large and the velocity of the fluid is slow or where there are low shear conditions, the viscosity of the fluid needs to be as high as possible in order to suspend and transport the drilled cuttings. This also applies to the periods when the fluid is left static in the hole, where both cuttings and weighting materials need to be kept suspended to prevent settlement. However, it should also be noted that the viscosity of the fluid should not continue to increase under static conditions to unacceptable levels. If this occurs, it can lead to excessive pressures when the fluid is circulated again that can fracture the formation, or alternatively it can lead to lost time if the force required to regain a fully circulating fluid system is beyond the limits of the pumps.

Depending on the particular well to be drilled, a drilling operator typically selects between a water-based drilling fluid and an oil-based or synthetic drilling fluid. Each of the water-based fluids and oil-based fluids typically include a variety of additives to create a fluid having the rheological profile necessary for a particular drilling application. For example, a variety of compounds are typically added to water- or brine-based well fluids, including viscosifiers, corrosion inhibitors, lubricants, pH control additives, surfactants, solvents, thinners, thinning agents, and/or weighting agents, among other additives. Some typical water- or brine-based well fluid viscosifying additives include clays, synthetic polymers, natural polymers and derivatives thereof such as xanthan gum and hydroxyethyl cellulose (HEC). Similarly, a variety of compounds are also typically added to an oil-based fluid including weighting agents, wetting agents, organophilic clays, viscosifiers, fluid loss control agents, surfactants, dispersants, interfacial tension reducers, pH buffers, mutual solvents, thinners, thinning agents and cleaning agents.

While the preparation of drilling fluids can have a direct effect upon their performance in a well, and thus profits realized from that well, methods of drilling fluid preparation have changed little over the past several years. Typically, the mixing method still employs manual labor to empty sacks of drilling fluid components into a hopper to make an initial drilling fluid composition. However, because of agglomerates formed as a result of inadequate high shear mixing during the initial production of the drilling fluid composition, screen shakers used in a recycling process to remove drill cuttings from a fluid for recirculation into the well also filter out as much as thirty percent of the initial drilling fluid components prior to the fluid's reuse. In addition to the cost inefficiency when a drilling fluid is inadequately mixed, and thus components are aggregated and filtered from the fluid, the fluids also tend to fail in some respect in their performance downhole. Inadequate performance may result from the observations that the currently available mixing techniques hinder the ability to reach the fluids rheological capabilities. For example, it is frequently observed that drilling fluids only reach their absolute yield points after downhole circulation.

Furthermore, for drilling fluids that incorporate a polymer that is supplied in a dry form, the adequacy of the initial mixing is further compounded by the hydration of those polymers. When polymer particles are mixed with a liquid such as water, the outer portion of the polymer particles wet instantaneously on contact with the liquid, while the center remains unwetted. Also effecting the hydration is a viscous shell that is formed by the outer wetted portion of the polymer, further restricting the wetting of the inner portion of the polymer. These partially wetted or unwetted particles are known in the art as "fish eyes." While fish eyes can be processed with mechanical mixers to a certain extent to form a homogenously wetted mixture, the mechanical mixing not only requires energy, but also degrades the molecular bonds of the polymer and reduces the efficacy of the polymer. Thus, while many research efforts in the drilling fluid technology area focus on modifying drilling fluid formulations to obtain and optimize rheological properties and performance characteristics, the full performance capabilities of many of these fluid are not always met due to inadequate mixing techniques or molecular degradation due to mechanical mixing.

Accordingly, there exists a need for improved techniques, which enable efficient and effective mixing of drilling fluids.

SUMMARY OF THE DISCLOSURE

In one aspect, embodiments disclosed herein relate to a method of mixing drilling fluids, the method including injecting a drilling fluid into a high shear mixing unit and processing the drilling fluid with the high shear mixing unit. The processing includes forcing the drilling fluid through at least a first row of teeth of a first stage.

In another aspect, embodiments disclosed herein relate to a high shear mixing unit for processing drilling fluid, the mixing unit including an inlet for receiving a drilling fluid, a body in fluid communication with the inlet, and a first stage disposed in the body, wherein the first stage includes a plurality of teeth.

In another aspect, embodiments disclosed herein relate to a method of processing drilling fluid at a drilling location, the method including injecting drilling fluid into a high shear mixing unit and forcing the drilling fluid through a first set of rotor teeth and corresponding stator teeth of a first stage. The method further includes discharging the drilling fluid from the high shear mixing unit.

Other aspects and advantages of the invention will be apparent from the following description and the appended claims.

DETAILED DESCRIPTION

In one aspect, embodiments disclosed herein relate to methods and apparatuses for mixing drilling fluids. More specifically, embodiments disclosed herein relate to methods and apparatuses for mixing drilling fluids with high shear mixers. More specifically still, embodiments disclosed herein relate to methods and apparatuses for mixing drilling fluids with multiple stage high shear mixers.

Traditional mixing techniques such as circulating the fluid through jets or impellers are becoming less satisfactory in achieving the desired properties of drilling fluids. Mixing techniques are now required that can adequately disperse chemical additives, but are gentle enough to preserve the long polymer chains and chemical structure of the additives. Embodiments disclosed herein may thus be used to adequately disperse chemical additives in drilling fluid, and may be used in both onshore and offshore drilling fluid mixing plants, on a drilling rig, or at other facilities. Such embodiments may be used to mix water-based, oil-based, and synthetic drilling fluids.

When determining a method to mix drilling fluids, a number of different options are available to fluid engineers. Methods may include using nozzles and low-pressure pumps, operating between 50-80 pounds per square inch (psi), which may achieve shear rates between 3000-5000 reciprocal seconds ($s^{-1}$). In other applications, drilling engineers may use nozzles and high-pressure pumps, operating between 700-800 psi, which may achieve shear rates between 30000-50000 $s^{-1}$. In still other applications, the drilling fluid may be mixed by pumping the fluid through the nozzle of a drill bit using a high-pressure triplex pump, which may achieve shear rates between 30000-80000 $s^{-1}$.

Embodiments of the present disclosure may thus provide methods and apparatuses for mixing drilling fluids using multiple stage high shear mixing units that reduce the need for high-pressure mixing equipment while producing fluids with high stability. Multiple stage high shear mixing units are typically of a rotor/stator design, wherein the motion of the rotor creates a centrifugal force on the drilling fluid, pushing it toward the inner wall of the stator. At the interface wall, the fluid is sheared between the rotor and the stator. The fluid is also subjected to additional hydraulic shear as it is forced at high velocities through narrow perforations machined into the stator. Specific design variants for rotor/stator combinations will be discussed in detail below.

Figure 1:
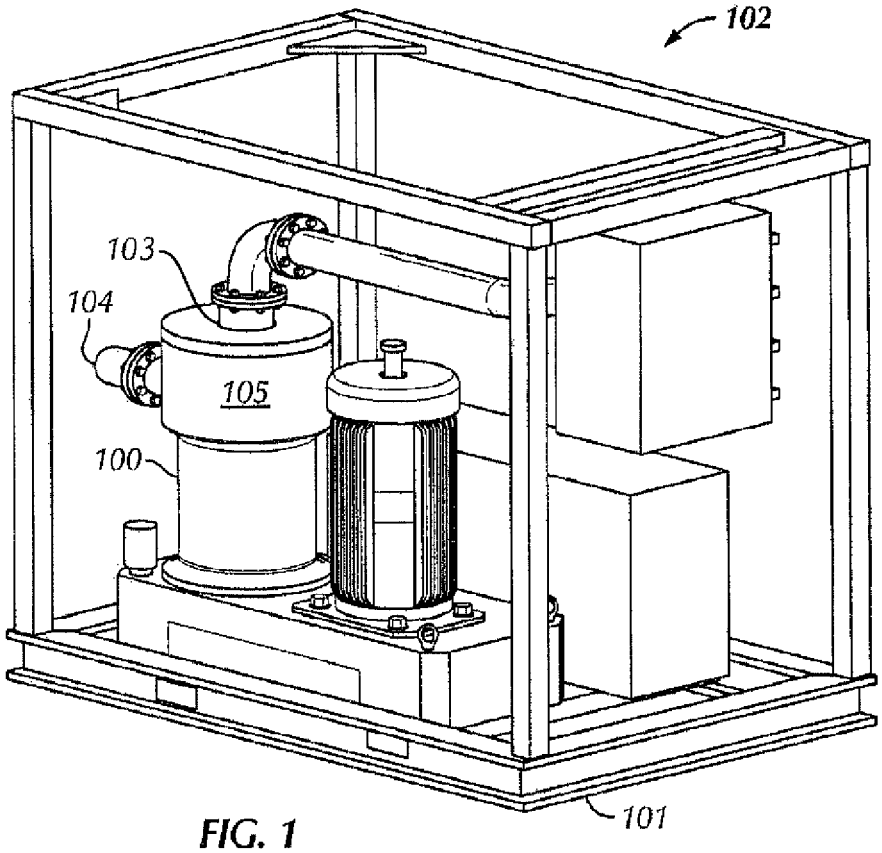
FIG. 1 is a multiple stage high shear mixing unit disposed on a skid according to embodiments of the present disclosure.

Referring initially to FIG. 1, a multiple stage high shear mixing unit 100 disposed on a skid 102 according to embodiments of the present disclosure is shown. In this embodiment, the multiple stage high shear mixing unit 100 includes a fluid inlet (not shown) for receiving a flow of unprocessed drilling fluid from a supply source (not shown), which may include tanks of new fluid or recycled fluid. Mixing unit 100 may also include a body 105 in fluid communication with the inlet 103, wherein the body 105 contains multiple rotor/stator combinations for processing the drilling fluid.

After the drilling fluid flows from the inlet and through body 105, the fluid is discharged from outlet 104. Outlet 104 may be connected to a holding tank (not shown) at the drilling site, which may be used to store mixed drill fluid until it is injected downhole. In other aspects, mixing unit 100 may be part of an inline system wherein fluid is processed in mixing unit 100, discharged to a high pressure pump (not shown), and injected downhole. In still other embodiments, mixing unit 100 may be used in a fluid processing plant, remote from the drilling site. Fluids may thus be mixed and discharged into containers for transport to a remote drilling site.

As illustrated, the mixing unit 100 is disposed on a skid 102, which may include a metal frame thereby allowing the entire system to be moved and modularly set up as needed. Depending on the requirements of the mixing operation, such as size constraints and the infrastructure at the drilling site, the skid 102 may also include other components, such as variable frequency drives (VFD), holding tanks, multiple mixing units 100, etc.

An actuator 101 is disposed on skid 102 and operatively coupled to mixing unit 100. Actuator 101 may include a motor (not shown) configured to rotate the rotor of mixing unit 100. In certain aspects, actuator 101 may be operatively coupled to a VFD, either disposed on skid 102 or at the drilling site, which may be used when operationally starting or stopping mixing unit 100.

Figure 2:
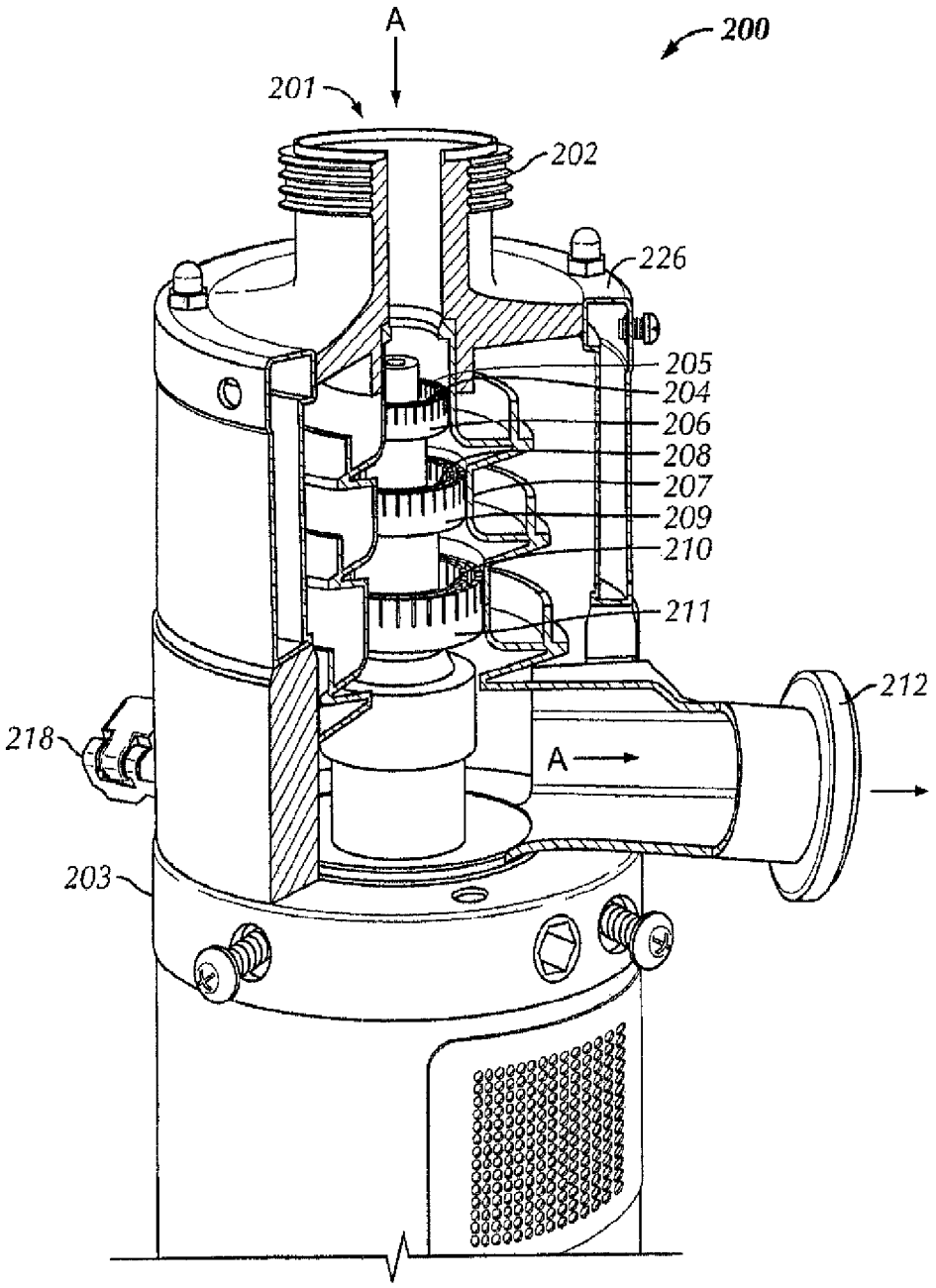
FIG. 2 is a partial cross-section of a mixing unit according to embodiments of the present disclosure.

Referring to FIG. 2, a partial cross-section of a mixing unit 200 according to embodiments of the present disclosure is shown. In this embodiment, mixing unit 200 has an inlet 201 configured to receive a flow of drilling fluid from a drilling fluid source (not shown). The inlet 201 may have a threadable connection 202, thereby allowing hoses, pipes, or other types of conduit to be connected thereto. As fluid is injected into inlet 201 along path A, the fluid flows into body 203, and disperses around rotor 204. As rotor 204 rotates, the centrifugal force causes the drilling fluid to be forced radially outward, thereby moving through rotor teeth 205. As the fluid is forced radially outward through rotor teeth 205, the fluid continues to move outward through stator teeth 206 and into contact with sidewall 207. As used herein, teeth refers to spaces, or slots, of a rotor or stator through which fluids may flow.

The fluid continues to be forced down body 203 and through a second set of teeth corresponding to second rotor 208. The fluid is forced through the second set of teeth, through stator teeth 209, and into contact with the sidewall 207 of body 203. After passing through the second set of corresponding teeth, the fluid continues to flow down the body 203 of mixer 200 to a third set of rotor teeth 210 and stator teeth 211. The fluid is forced through the third set of corresponding teeth and continues to flow along path A to outlet 212.

Outlet 212 may include a threadable connection capable of being connected to hoses, pipes, or other conduits, thereby allowing the transference of mixed drilling fluid from mixing unit 200 to holding tanks (not shown) or other infrastructure at a drilling site or fluid processing plant. In certain aspects, mixing unit 200 may include varied configurations of rotor and stator assemblies. For example, in certain aspects, mixing units 200 may include two sets of corresponding teeth formed from a dual rotor/stator assembly. In other aspects, mixing unit 200 may have less or more than three sets of corresponding teeth, such as one, four, five, or more.

Figure 3:
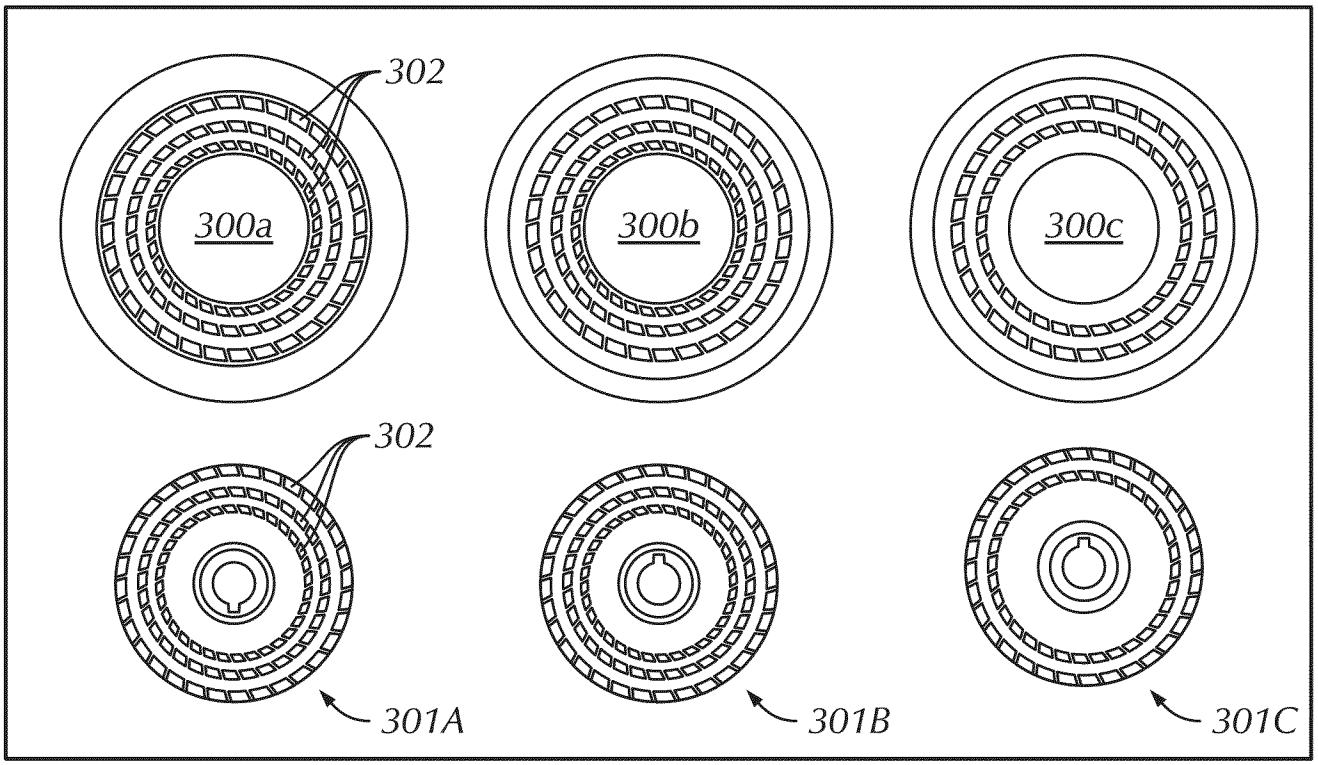
FIG. 3 is a breakaway view of stator/rotor combinations according to embodiments of the present disclosure.

Referring to FIG. 3, a breakaway view of stator/rotor combinations according to embodiments of the present disclosure is shown. In this embodiment, three stators 300A-C, and three corresponding rotors 301A-C are illustrated. In this aspect, each rotor/stator combination includes three rows of corresponding teeth 302. Thus, when assembled, the rotor/stator combination may include three or more sets of corresponding teeth, thereby further increasing the shearing action of the mixing unit. Each stator/rotor combination may be referred to as a stage. For example, rotor/stator combination 300A/301A may be referred to as a first stage, rotor/stator combination 300B/301B may be referred to as a second stage, and rotor/stator combination 300C/301C may be referred to as a third stage. When assembled in the body of the mixing unit, the fluid may pass through each stage progressively, thereby further shearing the fluid with each subsequent stage the fluid passes through.

Depending on the shearing action required for a particular drilling fluid, each stage may include corresponding teeth having a different gap (wherein gap is the distance between the rotor and stator), or a different spacing between individual teeth. Accordingly, different combinations of gap and tooth spacing may be used to produce a fluid with a particular rheology. Examples of different stages may include coarse, medium, fine and/or superfine stages. A coarse stage may have a greater gap or greater distance between individual teeth, while superfine stages may have a relative low distance gap and/or tooth spacing. In still other embodiments, one or more stages may be removed, thereby resulting in a mixing unit with less than the maximum number of potential stages. For example, a three stage mixing unit may be configured with only two stages. In other aspects, multiple stages may be substantially the same (e.g., two fine stages and one superfine stage) or all three stages may be different (e.g., one coarse stage, one fine stage, and one superfine stage). The stages used in a particular mixing unit may vary according to the type of drilling fluid being mixed or the particular requirements of a mixing operation.

In some aspects, the teeth of the rotors and stators may be coated or constructed from various materials to increase their resistance to wear. For example, in certain applications, the rotors and stators may be constructed from stainless steels, such as ferritic, martensitic, duplex, high performance austenic, and high performance duplex. Other materials and coatings may include tungsten carbide, nickel and silicon alloys (e.g., NiSil), Ni-hard and other alloys containing nickel, chromium, and molybdenum, 316 and 440 stainless steel, and polyurethane. Such materials may further be coated with elastomeric materials and/or polymers to further prevent the rotors and stators from experiencing wear, premature failure, and/or corrosion. Furthermore, by decreasing wear of the rotors and stators, the gap between the rotor and the stators may remain substantially constant for a longer time. Because the amount of shear decreases as the gap increases, the rotors and stators of the present disclosure may produce greater, more consistent shear, for a longer time period. In certain aspects, the gap between the rotor and stator may be between about 0.25 and 0.8 mm. Such a gap may results in sufficient shear to produce acceptable drilling fluid rheology. Those of ordinary skill in the art will appreciate that the gap between the rotor and stator may vary depending on the requirements for mixing particular fluids. In certain embodiments, the gap may be greater than 0.8 mm and still be effective for mixing fluids. Thus, by preventing wear to the rotors and stators the effectiveness of the mixer may be maintained.

Figure 4:
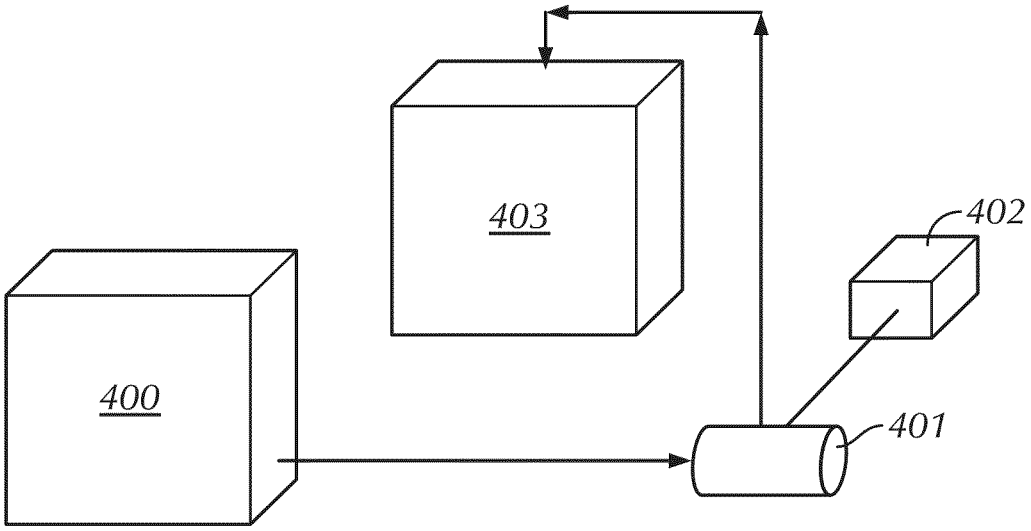
FIG. 4 is a schematic of a single pass inline mixing operation according to embodiments of the present disclosure.

Referring to FIG. 4, a schematic of a single pass inline mixing operation according to embodiments of the present disclosure is shown. In this embodiment, an unmixed drilling fluid is initially stored in drilling fluid source tank 400. Source tank 400 may vary in size depending on the requirements of the mixing operation from, for example, hundreds of gallons to several thousand gallons. The unmixed drilling fluid is then pumped to inline mixing unit 401, which may include a multiple stage high shear mixer. In certain applications, a pump may be used to facilitate the transference of unmixed drilling fluid from source tank 400 to mixing unit 401.

As illustrated, mixing unit 401 may also be operatively connected to a VFD 402. The VFD 402 may be used throughout operation of the mixing unit, or in other applications, may only be needed during starting of the mixing unit 401. In other aspects, mixing unit 401 may not require a VFD 402 for optimal operation. After the drilling fluid is mixed in mixing unit 401, the mixed drilling fluid is transferred to holding tank 403 for storage. Holding tank 403 may include pressurized or unpressurized vessels, mud pits, or holding tanks (e.g., tanks disposed on or within a transport vessel, such as a boat). In other applications, the mixed drilling fluid may be transferred to a high-pressure pump for further transference downhole.

After the drilling fluid is mixed by mixing unit 401, additional chemicals and/or additives may be added to the mixed drilling fluid. For example, in certain embodiments, additional polymers that do not require turbulent mixing may be added to the mixed drilling fluids. In certain aspects, weighting agents, such as barite, may be added to the mixed drilling fluid in holding tank 403. However, in other applications, all chemical polymers and/or weighting agents may be added to the unmixed drilling fluids, such that mixing unit 401 mixes all additives. In such an application, the mixed drilling fluid may then be stored or pumped downhole.

Figure 5:
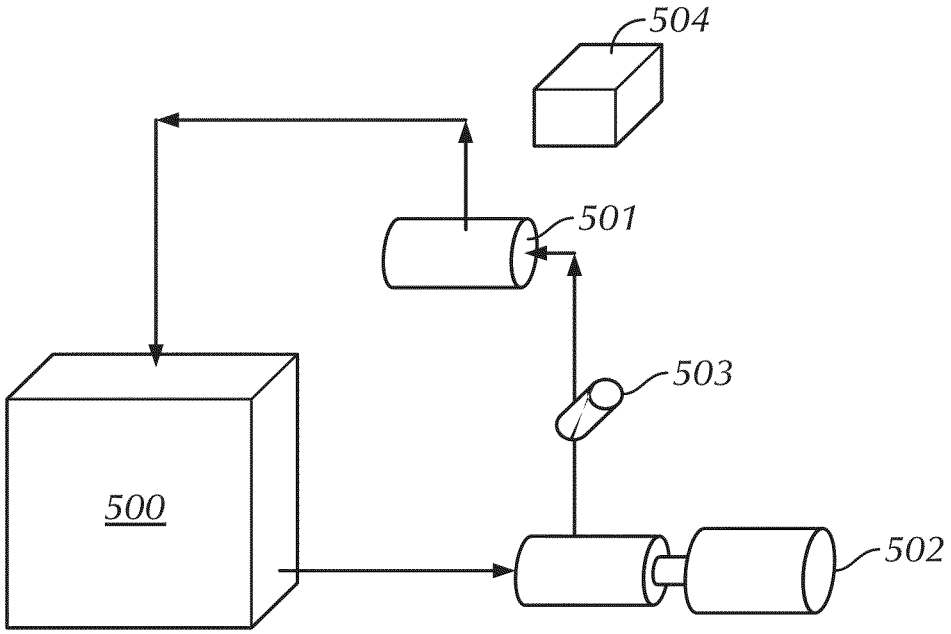
FIG. 5 is a schematic of a closed loop mixing operation according to embodiments of the present disclosure.

Referring to FIG. 5, a schematic of a closed loop mixing operation according to embodiments of the present disclosure is shown. In this embodiment, unmixed drilling fluid is transferred from a holding tank 500 to a mixing unit 501 through the use of a pump (e.g., a centrifugal pump) 502. An inline flow meter 503 may be disposed on the feed line between the pump 502 and mixing unit 501 to measure the rate the drilling fluid is being transferred between the holding tank 500 and the mixing unit 501. The mixing unit 501 mixes the drilling fluid and then cycles the mixed drilling fluid back to holding tank 500. As illustrated, a VFD 504 may be operatively connected to mixing unit 501, and may operate as described above.

In this embodiment, mixing unit 501 may process drilling fluid in several cycles, such that the drilling fluid may be continuously mixed until a fluid engineer determines the fluid rheology of the drilling fluid is acceptable for a given operation. Cycles such as this may also be used in fluid production facilities, where large volumes of drilling fluid are produced, loaded into transport vessels, and transported to drilling sites. Because large volumes of fluid may be mixed at a centralized location, a continuous loop cycle that allows drilling fluid to be constantly circulated may allow the fluids to retain the correct rheology for a given drilling operation for a longer time. Additionally, by providing multiple cycles with the drilling fluid, an acceptable fluid rheology may be maintained for longer time periods. Those of ordinary skill in the art will appreciate that multiple stage high shear mixers may produce an acceptable fluid rheology in a single cycle; however, it may still be advantageous in certain applications to process the fluid for several cycles.

The methods and apparatuses described above may be used inline at a drilling site for the processing of drilling fluid. In one aspect, a multiple stage high shear mixing unit includes an inlet for receiving drilling fluid and a body in fluid communication with the inlet. The body of the mixing unit may have at least a first and second rotor/stator combination, wherein the first and second rotor/stator combination has numerous corresponding teeth. During operation, a fluids engineer may actuate the mixing unit by starting a motor, thereby turning a drive shaft of the mixing unit, causing the rotors to rotate relative to their respective stators.

A drilling fluid may then be injected into the mixing unit, and the drilling fluid may be forced through the first set of corresponding slots of the first rotor/stator combination (i.e., a first stage). After being formed through the first set of corresponding slots, the drilling fluid may be forced through a second set of corresponding slots of a second rotor/stator combination (i.e., a second stage), and a mixed drilling fluid may be discharged through the outlet of the mixing unit. The mixed drilling fluid may then be transferred to a holding tank.

After the fluid is mixed, the fluid may either be held in a holding tank for use at a later time, or the fluid may be injected downhole, for example during drilling. The process of injecting, forcing, and discharging may be repeated, for example, in a closed-loop system, until a desired fluid rheology is achieved. In certain applications, a weighting agent may be added to the drilling fluid before or after mixing the fluid in the mixing unit, and in other applications, multiple mixing units may be run in parallel to increase the volume of drilling fluid produced.

During such operations, varied volumes of drilling fluid may be processed according to the requirements of the drilling operation and the capacity of the mixing pumps and holding tanks. In certain applications, lower volumes of drilling fluid may be produced if the drilling or fluid operation does not require such a great volume of fluid. Because the multiple stage high shear mixing units of the present application may mix fluids in a single pass, rather than with multiple passes, as is required by present mixing techniques, the time to produce drilling fluid may be decreased. Additionally, because the number of passes is decreased, the net cost of producing the drilling fluid may be decreased, as the overall energy expended in the process may be decreased.

To understand how multiple stage high shear mixing units produce high stability fluids, the operational dynamics of such mixing units in drilling fluid applications were determined. When mixing drilling fluids using a mixer having a rotor and stator, the effectiveness of the method may be measured, at least in part, based on the shear number. To determine the shear number, the fluid shear rate must be determined. Fluid shear rate is defined by the equation:

$$t=V/g \qquad \text{(Equation 1)}$$

where t is the shear rate measured in reciprocal seconds ($s^{-1}$), V is the tip speed of a rotor, measured in meters per second (m/s), and g is the gap distance measured in meters (m). The "gap" is defined as the distance between the rotor and the stator, and for purposes of the present disclosure, assumes a gap value prior to wear occurring. The differential speed between the rotor and the stator impart high shear and turbulent energy in the gap between the rotor and stator, thus the "tip speed" may be calculated according to the equation:

$$V=\pi\cdot D\cdot n \qquad \text{(Equation 2)}$$

where V is the tip speed measured in meters per second (m/s), D is the diameter of the rotor measured in meters (m), and n is the rotational speed of the rotor. In addition to determining tip speed and shear rate, the shear frequency, or the number of times that the rotor and stator openings mesh, may be determined according to the equation:

$$f_s=N_r\cdot N_s\cdot n \qquad \text{(Equation 3)}$$

wherein $f_s$ is shear frequency, $N_r$ is the number of rotor elements, $N_s$ is the number of stator elements, and n is the rotational speed of the rotor. Using the calculated shear frequency and the shear rate, a shear number may be determined by the equation:

$$S=f_s\cdot t \qquad \text{(Equation 4)}$$

wherein S is the Shear number measured in reciprocal seconds ($s^{-1}$), $f_s$ is the shear frequency calculated in Equation 3, and t is the shear rate measured in reciprocal seconds ($s^{-1}$) and determined in Equation 1. Because mixers of the present disclosure having rotor/stator designs may include multiple rows of teeth, the shear number must be applied for each row when determining how effective a particular design is at shearing drilling fluids.

Shear rate, shear frequency, and shear number may thus be used to analyze the potential effectiveness of a particular mixing unit. Table 1, below, provides an exemplary analysis to determine shear rate for a single stage mixing unit and a multiple stage mixing unit.

TABLE 1

| | | | |
|---|---|---|---|
| $V_1$ Shear Rate $s^{-1}$ | Shear Rate = (PI*N*D)/d | | |
| PI = | 3.1416 | | |
| N = | Rotational Speed of Rotor, REVS/SEC | | |
| D = | Diameter of Rotor, IN mm | | |
| d = | Shear Gap Width, IN mm | | |
| | Mixer Type | Single Stage | Multiple Stage |
| HP | | 2 | 10 |
| Rated Flow USGPM | | 60 | 10 |
| | Number of Stages | 1 | 3 |
| Calculate Tip Speed V, m/s | | 22 | 23 |
| Enter | N, IN rpm | 5400 | 5800 |
| Enter | D, mm | 79 | 75 |
| Shear Gap Width, in | d, in | 0.0009 | 0.01 |
| Enter | d, mm | 0.2286 | 0.254 |
| Calculate t, $s^{-1}$ | Shear Rate, t, $s^{-1}$ | 97711 | 89671 |

Table 2, below, provides an exemplary analysis to determine shear frequency and resultant shear number for a single stage mixing unit and a multiple stage mixing unit.

TABLE 2

| | Cavitations (pulsations) per second | | |
|---|---|---|---|
| Stage 1 coarse | Shear Frequency: $f_s = N_r \times N_s \times N$ | | Outside Row |
| Enter Number of Elements/Teeth on Rotor, $N_r$ | | 4 | 22 |
| Enter Number of Elements/Teeth on Stator, $N_s$ | | 26 | 21 |
| Enter Rotor Speed N, IN rpm | | 5400 | 5800 |
| Calculate $t_s$ | Shear Frequency | 9360 | 44660 |
| | Calculating Shear Number, S | | |
| | Shear Number: $S = f_s \times t$ | | |
| Calculate S, Shear Number | | 9.1E+08 | 4.0E+09 |
| Stage 1 coarse | Shear Frequency: $f_s = N_r \times N_s \times N$ | | Inside Row |
| Enter Number of Elements/Teeth on Rotor, $N_r$ | | NA | 22 |
| Enter Number of Elements/Teeth on Stator, $N_s$ | | NA | 21 |
| Enter Rotor Speed N, IN rpm | | NA | 5800 |
| Calculate $t_s$ | Shear Frequency | | 44660 |
| | Calculating Shear Number, S | | |
| | Shear Number: $S = f_s \times t$ | | |
| Calculate S, Shear Number | | | 2.9E+09 |
| Stage 2 Fine | Shear Frequency: $f_s = N_r \times N_s \times N$ | | Inside Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency | | 98987 |
| | Calculating Shear Number, S | | |
| | Shear Number: $S = f_s \times t$ | | |
| Calculate S, Shear Number | | 9.1E+08 | 6.5E+09 |

TABLE 2-continued

| | Cavitations (pulsations) per second | | |
|---|---|---|---|
| Stage 2 Fine | Shear Frequency: $f_s = N_r \times N_s \times N$ | | Middle Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency<br>Calculating Shear Number, S<br>Shear Number: $S = f_s \times t$ | | 98987 |
| Calculate S, Shear Number | | 9.1E+08 | 7.7E+09 |
| Stage 2 Fine | Shear Frequency: $f_s = N_r \times N_s \times N$ | | Outside Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency<br>Calculating Shear Number, S<br>Shear Number: $S = f_s \times t$ | | 98987 |
| Calculate S, Shear Number | | 9.1E+08 | 8.9E+09 |
| Stage 3 Fine | Shear Frequency: $f_s = N_r \times N_s \times N$ | | Inside Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency<br>Calculating Shear Number, S<br>Shear Number: $S = f_s \times t$ | | 98987 |
| Calculate S, Shear Number | | 9.1E+08 | 6.5E+09 |
| Stage 3 Fine | Shear Frequency: $f_s = N_r \times N_s \times N$ | | Middle Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency<br>Calculating Shear Number, S<br>Shear Number: $S = f_s \times t$ | | 98987 |
| Calculate S, Shear Number | | 9.1E+08 | 7.7E+09 |
| Stage 3 Fine | Shear Frequency: $f_s = N_r \times N_s \times N$ | | Outside Row |
| Enter Number of Elements/Teeth on Rotor, $N_r$ | | NA | 32 |
| Enter Number of Elements/Teeth on Stator, $N_s$ | | NA | 32 |
| Enter Rotor Speed N, IN rpm | | NA | 5800 |
| Calculate $t_s$ | Shear Frequency<br>Calculating Shear Number, S<br>Shear Number: $S = f_s \times t$ | | 98987 |

TABLE 2-continued

| Cavitations (pulsations) per second | | |
|---|---|---|
| Calculate S, Shear Number | 9.1E+08 | 8.9E+09 |
| Shear Number, Total | 9.1E+08 | 5.3E+10 |

The results of the analysis indicate that a multiple stage mixing unit has a higher shear number, thereby indicating that a multiple stage mixer may result in a mixed drilling fluid having acceptable fluid rheology after a single pass through the mixing unit. To further explain how multiple stage high shear mixing units may improve the process of mixing drilling fluid, a number of examples are presented below. Generally, the examples compare a single stage high shear mixing unit to a multiple stage high shear mixing unit designed to process drilling fluids.

Example 1

To test the ability of multiple stage high shear mixing units to mix drilling fluids, both multiple stage high shear mixing units and single stage high shear mixing units were setup in close proximity to both mixing and storage tanks as may occur in normal plant operation. Both mixing units were piped from a single pump discharge through an isolation valve, a wye strainer, etc. to the mixing units and back to the plant piping. The plant's fixed piping was also configured to pipe fluid to storage tanks, pumps, or a mixing tank. This configuration allowed the unmixed drilling fluid to be pumped to the inline mixing units and then back to storage, thereby allowing drilling fluid properties to be analyzed after a single pass through the mixing units.

In this example, a synthetic-based drilling fluid was originally tested. The testing procedure consisted of three hours of preparing the drilling fluid, followed by 30 minutes of shearing the drilling fluid with the mixing units. After shearing, the mixed drilling fluid was pumped back to storage tanks. During processing, each tank took approximately three to four hours to mix, and a total of 13 tanks (6500 BBL) were processed over a 45-hour time period. Samples were taken, and the quality of the mixed drilling fluid was analyzed in a drilling fluid plant laboratory.

Figure 6:
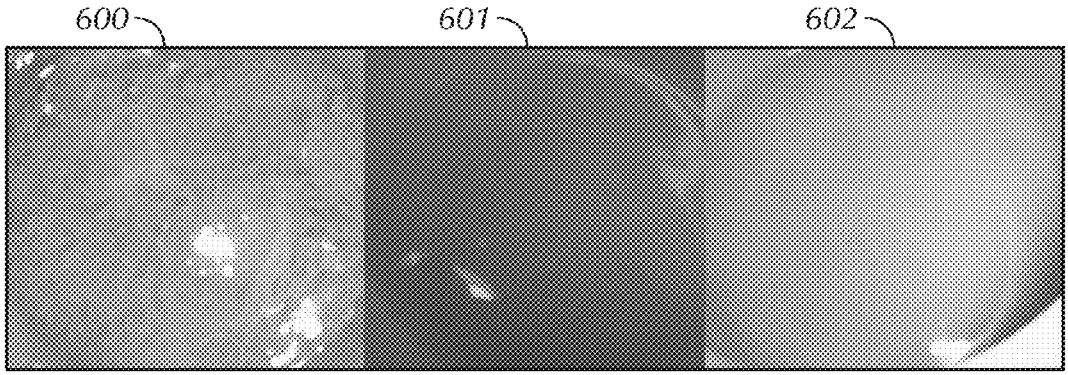
FIG. 6 is an illustration of a water-based drilling fluid after processing with a single stage mixing unit according to embodiments of the present disclosure.
Figure 7:
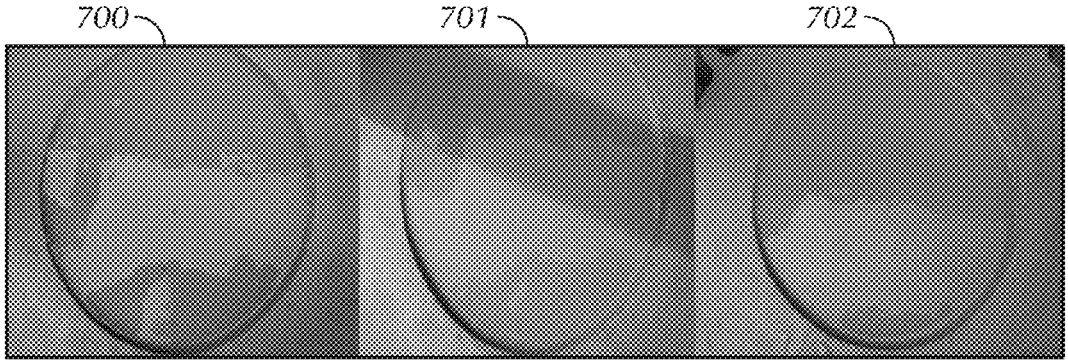
FIG. 7 is an illustration of a water-based drilling fluid after processing with a multiple stage mixing unit according to embodiments of the present disclosure.

Referring briefly to FIGS. 6 and 7, samples of drilling mud for both unweighted and weighted drilling fluids, respectively, according to embodiments of the present disclosure are shown. FIG. 6 illustrates the base drilling fluid sample before shearing 600, the drilling fluid sample after shearing with a single stage mixing unit 601, and the drilling fluid sample after shearing with a multiple stage mixing unit 602. Similarly, FIG. 7 illustrates the base drilling fluid sample before shearing 700, the drilling fluid sample after shearing with a single stage mixing unit 701, and the drilling fluid sample after shearing a multiple stage mixing unit 702. The samples include 350 ml of each drilling fluid, and illustrate a reduction in fish eyes after shearing with both mixing units. Further analysis concluded that the single stage mixing unit resulted in several fish eyes per 350 ml sample, while mixing with the multiple stage mixing unit resulted in one to two fish eyes per 350 ml sample. The test further indicated that fish eyes could be further reduced by building the drilling fluid and processing the drilling fluid with a multiple stage mixing unit prior to storage.

Data collected during the tests, as well as measured aspects of the drilling fluid rheology for the single stage mixing unit is summarized below in Table 3. The tests were conducted according to American Petroleum standards for testing drilling fluids.

TABLE 3

| Mud Properties<br>Tests: | Base | 1<br>700 L | 2<br>500 L | 3<br>800 L | 4<br>500 L | 5<br>700 L | 6<br>700 L |
|---|---|---|---|---|---|---|---|
| Density @ 20° C., kg/m$^3$ | 1075 | | | | | | |
| Rheology Temperature, ° C. | 50 | 50 | 50 | 50 | 50 | 50 | 50 |
| 600 rpm | 57 | 63 | 63 | 65 | 66 | 67 | 65 |
| 300 rpm | 37 | 41 | 41 | 42 | 43 | 43 | 42 |
| 200 rpm | 30 | 33 | 33 | 34 | 35 | 35 | 34 |
| 100 rpm | 21 | 24 | 24 | 25 | 25 | 25 | 25 |
| 6 rpm | 9 | 10 | 10 | 11 | 11 | 11 | 11 |
| 3 rpm | 8 | 9 | 9 | 10 | 10 | 10 | 10 |
| Plastic Viscosity, mPa-sec | 20 | 22 | 22 | 23 | 23 | 24 | 23 |
| Yield Point, Pa | 8.5 | 9.5 | 9.5 | 9.5 | 10 | 9.5 | 9.5 |
| 10 Second Gel Strength, Pa | 4.5 | 5 | 5 | 5.5 | 5.5 | 5.5 | 5.5 |
| 10 Minute Gel Strength, Pa | 6.5 | 7.5 | 7.5 | 7.5 | 8 | 8 | 7.5 |
| Electrical Stability, volts | 534 | 535 | 550 | 572 | 550 | 554 | 554 |

Data collected during the tests, as well as measured aspects of the drilling fluid rheology for the multiple stage mixing unit is summarized below in Table 4.

TABLE 4

| Mud Properties<br>Tests: | Base | 1<br>800 L | 2<br>800 L | 3<br>700 L | 4<br>800 L | 5<br>800 L | 6<br>550 L |
|---|---|---|---|---|---|---|---|
| Rheology Temperature, ° C. | 50 | 50 | 50 | 50 | 50 | 50 | 50 |
| 600 rpm | 64 | 67 | 67 | 67 | 68 | 68 | 70 |

TABLE 4-continued

| Mud Properties Tests: | Base | 1 800 L | 2 800 L | 3 700 L | 4 800 L | 5 800 L | 6 550 L |
|---|---|---|---|---|---|---|---|
| 300 rpm | 42 | 44 | 44 | 44 | 45 | 45 | 46 |
| 200 rpm | 33 | 35 | 35 | 35 | 36 | 36 | 38 |
| 100 rpm | 24 | 25 | 25 | 26 | 26 | 26 | 27 |
| 6 rpm | 10 | 11 | 11 | 12 | 12 | 12 | 13 |
| 3 rpm | 9 | 10 | 10 | 11 | 11 | 11 | 12 |
| Plastic Viscosity, mPa-sec | 22 | 23 | 23 | 23 | 23 | 23 | 24 |
| Yield Point, Pa | 10 | 10.5 | 10.5 | 10.5 | 11 | 11 | 11 |
| 10 Second Gel Strength, Pa | 5 | 5.5 | 5.5 | 6 | 6 | 6 | 6 |
| 10 Minute Gel Strength, Pa | 7.5 | 8 | 8 | 8 | 8.5 | 8.5 | 8.5 |
| Electrical Stability, volts | 523 | 556 | 574 | 583 | 600 | 613 | 620 |

Comparing the results of shearing the drilling fluid with a single stage mixing unit and a multiple stage mixing unit, both units produced drilling fluids having an electrical stability greater than 500, thereby indicating that the fluids had an acceptable carrying capacity for barite.

Example 2

In this example, an oil-based drilling fluid was prepared in a tank and subsequently processed by either a single stage or multiple stage mixing unit. For the single stage mixing unit, the unmixed drilling fluid was pumped to the mixing unit at a flow rate of 2800 liters per minute. For the multiple stage mixing unit, the unmixed drilling fluid was pumped to the mixing unit at a flow rate of 400 liters per minute. Thus, the flow rate for the single stage mixing unit was substantially greater than for the multiple stage mixing unit.

Table 5, below, provides test results for the single stage mixing unit. The electrical stability (ES in the table) was measured for each test, according to the methods discussed above. Prior to processing the fluid, the Start ES was measured, and then after the fluid was processed, and End ES was measured. The change refers to the change in ES over the duration of the processing. Tank Vol. Turnovers refers to the number of cycles through the test the fluid was processed. Thus, an ES per Turnover, an ES per volume per hour, and an ES per hour was calculated for each trial.

TABLE 5

| Trials | Units | 1-1 | 1-3 | 1-4 | 1-5 | 1-6 | 1-7 | 2-3 | 3-1 |
|---|---|---|---|---|---|---|---|---|---|
| Start ES | Volts | 400 | 381 | 342 | 403 | 356 | 342 | 520 | 285 |
| End ES | Volts | 648 | 460 | 422 | 386 | 518 | 543 | 550 | 438 |
| Flow Rate | L/min | 2800 | 2800 | 2800 | 2800 | 2800 | 2800 | 2800 | 2800 |
| Tank Volume | $M^3$ | 30 | 30 | 30 | 30 | 30 | 30 | 30 | 30 |
| Change | Volts | +148 | +79 | +80 | −17 | +162 | +201 | +30 | +153 |
| Duration | Hours | 1.5 | 1.3 | 1.42 | 1.33 | 1.33 | 1.5 | 0.5 | 2 |
| Mud S.G. | | 1.34 | 1.34 | 1.34 | 1.34 | 1.34 | 1.34 | 1.34 | 0.9 |
| Tank Vol. Turnovers | | 7.6 | 7 | 7 | 7 | 7 | 7 | 3.1 | 11 |
| ES per Turnover | Volts | 32.5 | 11.3 | 11.4 | −2.4 | 23.1 | 28.5 | 9.8 | 13.8 |
| $ES/m^3/Hr$ | Volts | 5.5 | 1.98 | 1.88 | −0.43 | 4.06 | 4.47 | 2 | 1.92 |
| ES/Hr | Volts | 165.3 | 59.4 | 56.3 | −12.8 | 121.8 | 134 | 60 | 57.5 |
| ES/KW | Volts | 1.83 | 0.66 | 0.63 | −0.14 | 1.35 | 1.49 | 0.67 | 0.64 |

Table 6, below, provides test results for the multiple stage mixing unit. The electrical stability (ES in the table) was measured for each test, according to the methods discussed above. Prior to processing the fluid, the Start ES was measured, and then after the fluid was processed, and End ES was measured. The change refers to the change in ES over the duration of the processing. Tank Vol. Turnovers refers to the number of cycles through the test the fluid was processed. Thus, an ES per Turnover, an ES per volume per hour, and an ES per hour was calculated for each trial.

TABLE 6

| Trials | Units | 1-2 | 1-8 | 1-9 | 1-10 | 2-1 | 2-2 | 3-2 |
|---|---|---|---|---|---|---|---|---|
| Start ES | Volts | 435 | 300 | 408 | 423 | 438 | 385 | 238 |
| End ES | Volts | 511 | 535 | 537 | 520 | 526 | 511 | 370 |
| Flow Rate | L/min | 978 | 566 | 400 | 566 | 350 | 400 | 400 |
| Tank Volume | $M^3$ | 30 | 30 | 30 | 30 | 30 | 30 | 30 |
| Change | Volts | +76 | +235 | +129 | | +88 | +126 | +132 |
| Duration | Hours | 1.3 | 1.2 | 1.5 | 1.5 | 1.5 | 1.3 | 2 |
| Mud S.G. | | 1.34 | 1.34 | 1.34 | 1.34 | 1.34 | 1.34 | 0.9 |

TABLE 6-continued

| Trials | Units | 1-2 | 1-8 | 1-9 | 1-10 | 2-1 | 2-2 | 3-2 |
|---|---|---|---|---|---|---|---|---|
| Tank Vol. Turnovers | | 2.2 | 1.6 | 1.0 | 1.0 | 1.4 | 1.2 | 2.3 |
| ES per Turnover | Volts | 34 | 144.7 | 126 | 95.4 | 65 | 108 | 58 |
| ES/m$^3$/Hr | Volts | 1.9 | 6.53 | 2.87 | 2.16 | 1.96 | 3.23 | 2.2 |
| ES/Hr | Volts | 57.14 | 195.8 | 86 | 64.6 | 58.67 | 96.92 | 66 |
| ES/KW | Volts | 1.27 | 4.35 | 1.91 | 1.44 | 1.30 | 2.15 | 1.47 |

The results indicate that both single stage and multiple stage mixing units may shear the tested fluid to achieve acceptable electrical stability. However, the single stage mixing unit requires a substantially higher flow rate to achieve acceptable electrical stability levels. Higher flow rates may result in more wear to the internal components, such as the rotors, stators, or teeth in the single stage mixing unit compared to the multiple stage mixing unit. To determine wear, the rotors and stators were evaluated to determine if there was a change in dimension or a loss of mass as a result of the processing. The results of the evaluation show that some wear occurred to both the single stage and the multiple stage mixing units. However, because the flow rate of the drilling fluid through the multiple stage mixing unit was lower, the wear was substantially less.

Additionally, due to the design of single stage mixing units, the gap between the rotor and stator may increase more quickly than in a multiple stage mixing unit. Once the gap between the rotor and stator increases, the shearing capacity of the unit decreases, thereby decreasing the effectiveness of the unit. Because the multiple stage mixing unit experienced less overall wear, components of the multiple stage mixing unit may not need to be replaced as frequently (the results of the analysis indicated that the multiple stage mixing unit may process 5.5 times the volume of drilling fluid than the single stage mixing unit before the multiple stage mixing unit failed).

Example 3

In this example, an oil-based drilling fluid was prepared in a tank and subsequently processed by a multiple stage mixing unit. Prior to shearing, a pre-mix fluid was prepared including calcium carbonate but without barite. A total of 3800 barrels of fluid were processed using a multiple stage mixing unit having three sets of rotors and stators and capable of processing 550 gpm. During the testing, three trials were conducted. In the first trial, a total of approximately 1200 barrels of fluid was mixed. The first portion barrels were premixed with calcium carbonate and sent to storage. The second portion barrels were mixed for two passes then weighted with barite. In the second trial, 418 barrels of fluid were pre-mixed and continuously sheared for three passes from the mixing tank through the shearing unit and returned to the original mixing tank. In the third trial, 350 barrels of unweighted fluid were pre-mixed and immediately sheared until the electrical stability of the fluid was raised to a predetermined level. The results of the tests are summarized below in Table 7:

TABLE 7

| | UNIT SIZE | Trial 1 | Trial 2 | Trial 3 |
|---|---|---|---|---|
| PRODUCT | | | | |
| ESCADE 110 BASE FLUID | BBL, 42 GAL | 792 + add 400 | 264 | 222 |
| VG PLUS | BG, 50 LB | 147 | 49 | 48 |

TABLE 7-continued

| | UNIT SIZE | Trial 1 | Trial 2 | Trial 3 |
|---|---|---|---|---|
| LIME | BG, 55 LB | 95 | 31 | 14 |
| VERSACOAT HF | DM, 55 GAL | 15 | 5 | 5 |
| VERSAWET | DM, 55 GAL | 8 | 3 | 3 |
| WATER (DRILL WATER) | BBL, 42 GAL | 110 | 37 | 92 |
| CaCl2 11.6 PPG BRINE | BBL, 42 GAL | 170 | 57 | 212 |
| VERSATROL | BG, 50 LB | 85 | 28 | 24 |
| HRP | DM, 55 GAL | 1.5 | 0.5 | — |
| SAFECARB 20 | BG, 1 MT | 22 | 7 | — |
| BARITE BB | BG, 1.5 MT | 58 | 19 | — |
| PRODUCT PRODUCED | | | | |
| VERSACLEAN MUD 10.5-10.8 PPG | BBL, 42 GAL | 1256 | 418 | — |
| VERSACLEAN PREMIX | | — | — | 350 |

During the first trial, the mud was sheared for two passes and the ES values increased 109 V with the first pass and 54 V with the second pass for a total increase of 163 V. After two passes, the ES reached the value of 223 V, and after the sheared mud was weighted with barite, the ES value further increased to 291 V. The average flow rate during the trial was 407 gpm. In the second trial, 400 barrels of mud was built and left overnight in a mud tank. The mud was then rolled for two hours in the tank and sheared for three passes through the mixing unit. The average flow rate during the trial was 400 gpm. During the second trial, the ES values increased from 57 V to 65 V after the first pass and increased to 100 V after the second pass, with no increase recorded during the third pass. Barite addition contributed to a further ES increase, up to a total of 152 V. During the third trial, the shearing was started at the end of the mud mixing process. The average flow rate during the third trial was 404 gpm, and samples were collected after one pass and after a second pass through the mixing unit. After the first pass, the ES was 505 V and after the second pass the ES was 623 V. The ES of the collected samples was then remeasured 18-20 hours later, and the ES of the fluid after the first pass was 650 V and the ES of the fluid after the second pass was 700 V.

Advantageously, embodiments of the present disclosure may provide apparatuses and methods of mixing drilling fluids having acceptable fluid rheology. In certain aspects, multiple stage mixing units may be used to process drilling fluids, such that a drilling fluid may be processed in a single pass through the mixer. Additionally, the multiple stage mixing unit may be disposed inline at a drilling site, thereby allowing the drilling fluid to be processed a relatively short time before it is pumped downhole. In other aspects, the drilling fluid may be mixed with a multiple stage high shear mixing unit and stored for a select period of time before use. Because the multiple stage high shear mixing unit may provide optimal fluid properties, the fluid may be stored for longer periods of time without the requirement that the drilling fluid be reprocessed prior to use in a drilling operation.

Also advantageously, embodiments of the present disclosure may provide apparatuses that resist wear more effectively than existing mixing units. In certain aspects, the multiple stage mixing units disclosed herein may include wear resistant internal components or coating on such components that may further increase the life of the mixing unit. By increasing the life of the mixing unit, the total cost of providing fluid for a drilling operation may be decreased. Additionally, because multiple stage mixing units may process a greater volume of drilling fluid before components, such as rotors and stators, require replacement, the cost of processing drilling fluid may be decreased, as well as rig downtime, thereby further decreasing the total cost of drilling operations. To further decrease the cost of drilling, embodiments of the present disclosure may also decrease the number of circulation cycles a drilling fluid goes through prior to drilling. Thus, rather than cycle the drilling fluid downhole a number of times prior to commencing drilling, a pre-mixed drilling fluid may be used without such circulation cycles.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of mixing drilling fluids, the method comprising:

injecting a drilling fluid into a high shear mixing unit; and processing the drilling fluid with the high shear mixing unit, wherein the processing comprises:

forcing the drilling fluid through one or more stages of the high shear mixing unit, such that the drilling fluid enters a second stage proximate to an outer diameter of a first stage, the second stage having an outer diameter greater than the outer diameter of the first stage, wherein the one or more stages each comprise a rotor and a stator and the outer diameter of each stage is defined by the outer diameter of the stator.

2. The method of claim 1, further comprising:

forcing the drilling fluid through a first rotor and a first stator of the first stage.

3. The method of claim 1, wherein the drilling fluid comprises at least one of a group of water-based drilling fluids, oil-based drilling fluids, and synthetic drilling fluids.

4. The method of claim 1, wherein the injecting further comprises injecting drilling fluid at a rate of up to 1000 gallons per minute into the high shear mixing unit.

5. The method of claim 1, further comprising:

reinjecting the drilling fluid into the high shear mixing unit.

6. The method of claim 1, wherein the high shear mixing unit is disposed inline at a drilling site.

7. A method of processing drilling fluid at a drilling location, the method comprising:

injecting drilling fluid into a high shear mixing unit;

forcing the drilling fluid through at least a first set of rotor teeth and corresponding stator teeth of a first stage of the high shear mixing unit, wherein the first stage has a first diameter;

contacting the drilling fluid against a sidewall of the high shear mixing unit;

forcing the drilling fluid down the sidewall of the high shear mixing unit to the second stage and out through at least a second set of rotor teeth and corresponding stator teeth of a second stage, wherein the second stage has a second diameter greater than the first diameter, wherein the one or more stages each comprise a rotor and a stator and the outer diameter of each stage is defined by the outer diameter of the stator; and discharging the drilling fluid.

8. The method of claim 7, further comprising:

forcing the drilling fluid through a third set of rotor teeth and corresponding stator teeth of a third stage.

9. The method of claim 7, further comprising:

injecting the drilling fluid downhole.

10. The method of claim 7, further comprising:

repeating the steps of injecting, forcing, and discharging until a desired drilling fluid rheology is reached.

11. The method of claim 10, further comprising:

adding a weighting agent to the drilling fluid.

12. The method of claim 7, further comprising:

transferring the drilling fluid to a holding tank.

* * * * *